US007662244B2

(12) United States Patent
Yoshizawa et al.

(10) Patent No.: US 7,662,244 B2
(45) Date of Patent: Feb. 16, 2010

(54) MARTENSITIC STAINLESS STEEL AND METHOD FOR MANUFACTURING SAME

(75) Inventors: Mitsuru Yoshizawa, Amagasaki (JP); Kunio Kondo, Sanda (JP); Masaaki Igarashi, Sanda (JP); Yuichi Komizo, Nishinomiya (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 46 days.

(21) Appl. No.: 10/443,821

(22) Filed: May 23, 2003

(65) Prior Publication Data

US 2003/0217789 A1 Nov. 27, 2003

Related U.S. Application Data

(63) Continuation of application No. PCT/JP02/10394, filed on Oct. 4, 2002.

(30) Foreign Application Priority Data

Oct. 19, 2001 (JP) ..... 2001-322548

(51) Int. Cl.
*C22C 38/18* (2006.01)

(52) U.S. Cl. ..... 148/325

(58) Field of Classification Search ..... 148/325
See application file for complete search history.

(56) References Cited

U.S. PATENT DOCUMENTS

| | | | | |
|---|---|---|---|---|
| 3,791,819 | A * | 2/1974 | Loutzenhiser et al. | 75/458 |
| 4,125,771 | A | 11/1978 | Erwin | |
| 4,671,827 | A * | 6/1987 | Thomas et al. | 148/609 |
| 5,129,966 | A * | 7/1992 | Rao | 148/542 |
| 5,232,520 | A * | 8/1993 | Oka et al. | 148/542 |
| 6,254,698 | B1 * | 7/2001 | Koo et al. | 148/336 |
| 6,273,968 | B1 * | 8/2001 | Thomas | 148/333 |
| 6,379,821 | B2 * | 4/2002 | Kushida et al. | 428/685 |
| 6,746,548 | B2 * | 6/2004 | Kusinski et al. | 148/320 |

FOREIGN PATENT DOCUMENTS

| | | |
|---|---|---|
| JP | 05-112818 | 5/1993 |
| JP | 08-120415 | 5/1996 |
| JP | 08-260038 | 10/1996 |
| JP | 11-310823 | 11/1999 |
| JP | 2000-368697 | 11/1999 |
| JP | 2000-119748 | 4/2000 |
| JP | 2000-226614 | 8/2000 |
| JP | 2000-575092 | 8/2000 |
| JP | 2001-226749 | 8/2001 |
| JP | 2001-600360 | 8/2001 |
| WO | WO 01/04365 | 1/2001 |

OTHER PUBLICATIONS

English abstract of Japanese patent 74013127, Mar. 29, 1974.*
ASM international, materials Park, Ohio, Metallographer's Guide:Practices and Procedures for Iron and Steels, Chapter 1, "Introduction to Steels and Cast Irons" p. 3, 1999.*
Davis et al., Metals Handbook, Dec. 31, 1998, Desk Edition, pp. 976-977.*
Davis et al., ASM Handbook, Mar. 31, 1990, Tenth Edition, vol. 1, pp. 468-469 and 737-742.*
Miyata et al., Corrosion perfomance of weldable 12% chromium stainless steel seamless line pipes, 1999, pp. 231-241.*
Machine Translation of Kushida et al. (JP 2000-119748).*
ASM International, Materials Park, Ohio, Properties and Selection: Irons, Steels, and High-Performance Alloys: Classification and Basic Metallurgy of Cast Iron, vol. 1, pp. 3-11, Mar. 1990.*

* cited by examiner

*Primary Examiner*—Roy King
*Assistant Examiner*—Jessee R. Roe
(74) *Attorney, Agent, or Firm*—Clark & Brody

(57) ABSTRACT

A martensitic stainless steel provided includes C: 0.01-0.1% and Cr: 9-15%, and the retained austenite phase has a thickness not more than 100 nm in such a manner that the X-ray integral intensities of 111γ and 110α satisfy the following formula (a):

$$0.005 \leqq 111\gamma/(111\gamma+110\alpha) \leqq 0.05 \quad \text{(a)}$$

Such a metal structure can be obtained by the following procedure: the steel is heated at a temperature of the $Ac_3$ point or more, and then cooled from 800° C. to 400° C. at a cooling rate of not less than 0.08° C./sec and further cooled down to 150° C. at a cooling rate of not more than 1° C./sec. The martensitic stainless steel according to the present invention has a relatively high carbon content and a greater toughness in spite of a high mechanical strength, and further exhibits an excellent corrosion resistance, so that it is particularly effective as the material for constructing a deep oil well.

18 Claims, 1 Drawing Sheet

MARTENSITIC STAINLESS STEEL AND METHOD FOR MANUFACTURING SAME

This application is a continuation of International Patent Application No. PCT/JP02/10394 Filed Oct. 4, 2002. This PCT application was in English as published under PCT Article 21(2).

TECHNICAL FIELD

The present invention relates to a martensitic stainless steel, which has excellent properties as for the corrosion resistance, the stress corrosion cracking resistance, the mechanical strength and the toughness, thereby preferably usable as a material for a steel pipe to construct, e.g., an oil well or a gas well (hereinafter generally being referred to as "oil well") as well as to transport crude oil or natural gas. The present invention also relates to a method for manufacturing such a martensitic stainless steel.

BACKGROUND ART

In a corrosive environment containing carbon oxide and a very small amount of hydrogen sulfide, a 13% Cr martensitic stainless steel is normally used, because such an environment requires excellent properties regarding the corrosion resistance, the stress corrosion cracking resistance, the weldability, the toughness and the mechanical strength as for a steel material. Specifically, API-13% Cr steel (13% Cr-0.2% C), which is specified according to the standard of the API (American Petroleum Institute), is widely used in such an environment, because it has an excellent corrosion resistance to carbon dioxide. The API-13% Cr steel can be used as a material for a conventional oil country tubular goods which require a mechanical strength of order of yield stress 552-655 MPa (80-95 ksi). However, API-13% Cr steel has a relatively small toughness and therefore cannot be used as a material for a deep oil well steel pipe which requires a much greater mechanical strength of order of yield stress more than 759 MPa (110 ksi).

In recent years, improved type 13% Cr steel, which includes carbon in an extremely reduced amount and which includes Ni instead of carbon, has been developed to improve the corrosion resistance. Since the improved type 13% Cr steel provides an excellent toughness even in an increased mechanical strength and therefore can be used in a much severer corrosive environment, it is increasingly used in an environment requiring a high mechanical strength. However, a decrease in the C content tends to provide the precipitation of δ ferrite, which are harmful for the hot workability, the corrosion resistance, the toughness and the like as for steel. As a result, an appropriate amount of Ni, which is considerably expensive, has to be included in the steel in accordance with the amounts of both Cr and Mo added, thereby causing its price to be considerably increased.

In order to overcome such a problem, several attempts have been made to improve the toughness in the 13% Cr steel having a high mechanical strength. For instance, in Japanese Patent Application Laid-open No. 8-120415, an attempt has been made to improve the mechanical strength and the toughness on the basis of API-13% Cr steel, using active N which cannot be immobilized by Al. However, the 13% Cr steel in the prior art has an yield stress of 552-655 MPa (80-95 ksi) and a fracture appearance transition temperature of −20 to −35° C. in the Charpy impact test, as described in the examples of the embodiments, so that the toughness cannot be obtained even in a high mechanical strength of more than 759 MPa (110 ksi).

On the other hand, a number of technologies have been disclosed to use the retained austenite in order to improve the property of 13% Cr steel. In Japanese Patent Application Laid-open No. 5-112818, a technology is disclosed for thermally refining 13% Cr steel to provide a low mechanical strength and a high toughness through the precipitation of coarse carbide particles in a martensite structure having a high carbon content, wherein the heating in a dual phase region is carried out prior to the annealing to segregate carbon in an austenite phase newly generated in prior austenite grains and then the annealing treatment is carried out.

In Japanese Patent Application Laid-open No. 8-260038, a technology is disclosed for thermally refining a 13% Cr steel to provide a low mechanical strength and a high toughness by weakening the solution strengthening effect, wherein C and Ni in the austenite are enriched by heating in a dual phase region and thereby reduces the C and Ni contents in the martensite as a parent phase.

However, these technologies are used only to thermally refine the 13% Cr steel so as to securely provide a low mechanical strength and a high toughness, but provide no means for increasing the mechanical strength and the toughness by improving the property of the 13% Cr steel.

Moreover, a technology has been disclosed to obtain a steel having a high mechanical strength and a high toughness by utilizing the retained austenite in the steel. In Japanese Patent Application Laid-open No. 11-310823, a technology for obtaining a high mechanical strength and a high toughness wherein a 13% Cr steel containing carbon is heated in a dual phase region at $Ac_1$-$Ac_3$ to form reverse transformed austenite in the parent phase of martensite, and a tempering treatment is then performed at a temperature of lower than $Ac_1$. In the specification, however, no reference is made for the technology providing a steel material having such a high mechanical strength as yield stress of greater than 759 MPa (110 ksi), which is required for developing deep oil wells.

In Japanese Patent Application Laid-open No. 2000-226614, furthermore, a technology for providing a high mechanical strength and a high toughness has been disclosed, wherein the heating in a dual phase region is carried out at $Ac_1$-$Ac_3$ in an improved type 13% Cr steel having a low carbon content so as to form austenite in the parent phase of martensite. However, although it is sure that the steel disclosed therein provides a high toughness, a greater content of expensive nickel is used and also the thermal treatment is carried out in a restricted control range in order to precipitate the retained austenite. Accordingly, there exists a problem that the price of the steel is greatly increased, compared with the API-13% Cr steel.

As described in the above-mentioned Japanese Patent Application Laid-opens No. 5-112818 and No. 2000-226614 respectively, it is known that the existence of retained austenite in the steel provides an improvement of the toughness in the 13% Cr steel. On the other hand, it is also known that the existence of retained austenite in the steel reduces the mechanical strength (for instance, Japanese Patent Application Laid-open No. 8-260038). Consequently, it can be assumed that the existence of retained austenite in the steel improves the toughness of the steel, but at the same time reduces the mechanical strength.

Moreover, as described in the above-mentioned Japanese Patent Application Laid-opens No. 11-310823 and No. 2000-226614, the method for producing the steel having a high mechanical strength and a high toughness by utilizing the retained austenite is demonstrated. Nevertheless, the method has not yet disclosed capable of obtaining the steel material, which has such a high toughness and provides such a reduced cost as applicable to the development of oil wells requiring an yield stress of greater than 759 MPa (110 ksi).

DISCLOSURE OF THE INVENTION

In view of the above-mentioned problems in the prior art, it is an object of the present invention to provide a martensitic stainless steel, which has an excellent corrosion resistance required to construct an oil well, in particular an excellent mechanical strength and a high toughness which are required to construct a deep oil well, along with the productivity at a reduced cost. It is another object of the present invention to provide a method for manufacturing such a martensitic stainless steel.

Through a number of investigations made so far to produce steels having such a high mechanical strength as a yield stress of more than 759 MPa and also a high toughness, and which are capable of producing at a reduced cost in order to attain the object, the present inventors have found a technological knowledge that a high mechanical strength and a high toughness in a steel can be obtained by appropriately controlling the shape and the amount of precipitationes in retained austenite, even if the amount of added nickel is reduced.

The invention has completed on the basis of the findings, and the object is attained by (1) the following martensitic stainless steels and (2) the following method of producing such a martensitic stainless steel:

(1) A martensitic stainless steel including carbon in a content of 0.01-0.1 mass % and chromium in a content of 9-15 mass %, wherein the thickness of retained austenite in the steel is smaller than 100 nm, and X-ray integration intensities $111\gamma$ and $110\alpha$ satisfy the following formula (a):

$$0.005 \leqq 111\gamma/(111\gamma+110\alpha) \leqq 0.05 \quad \text{(a)}$$

where $111\gamma$ and $110\alpha$ are the X-ray integration intensities of the austenite phase (111) plane and the martensite phase (110) plane, respectively.

Alternately, a martensitic stainless steel according to the invention preferably includes Si: 0.05-1%, Mn: 0.05-1.5%, P: not more than 0.03%, S: not more than 0.01%, Ni: 0.1-7%, Al: not more than 0.05% and N: not more than 0.1% in mass %, the residual being Fe and impurities, in addition to the above-mentioned martensitic stainless steel.

Alternately, a martensitic stainless steel according to the invention preferably includes one or more elements in the following compositions or each of the following groups in addition to the above-mentioned martensitic stainless steel:

Cu: 0.05-4%

Mo: 0.05-3%;

Group A; Ti: 0.005-0.5%, V: 0.005-0.5% and Nb: 0.005-0.5%,

Group B; B: 0.0002-0.005%, Ca: 0.0003-0.005%, Mg: 0.0003-0.005% and rare earth elements: 0.0003-0.005%.

(2) A method for producing a martensitic stainless steel, wherein one of the above-mentioned martensitic stainless steels is heated at a temperature of the $Ac_3$ point or more, and then cooled from 800° C. to 400° C. a cooling rate of not less than 0.08° C./sec, and further cooled down to 150° C. at a cooling rate of not more than 1° C./sec.

The above-mentioned cooling rate is referred to the condition specified in the final stage of heat treatment. The cooling rate can also be employed such that, after a steel is heated at a temperature of the $Ac_3$ point or more and hot-worked, the steel is cooled from 800° C. to 400° C. at a cooling rate of not less than 0.08° C./sec, and further cooled down to 150° C. at a cooling rate of not more than 1° C./sec.

The present invention is realized on the basis of the findings, which is accumulated by the following investigations. These investigations and the approach applied thereto are as follows:

Firstly, in order to finely disperse retained austenite particles, the conventional heat treatment, i.e., the heating in a dual phase region at a temperature of $Ac_1$-$Ac_3$, was carried out by changing the temperature and the heating duration, and then the shape and amount of the precipitated retained austenite particles as well as the mechanical properties were studied.

FIG. 1 shows an electron microscopic photograph of a metal structure which was obtained by heating 12% Cr-6.2% Ni-2.5% Mo-0.007% C steel in dual phase region (640° C., for 1 hr, and natural cooling). As can be recognized in the photograph, the retained austenite is precipitated in the form of relatively coarse grains inside the parent phase of martensite and in the vicinity of the old austenite grain boundaries. The thickness of a retained austenite particle was approximately 150 nm and the yield stress obtained was as small as 607 MPa.

As shown in FIG. 1, the formation of relatively coarse retained austenite particles is due to the fact that the heating in a dual phase region at a temperature of $Ac_1$-$Ac_3$ provides relatively coarse precipitated particles of reverse transformed austenite in which elements for forming austenite, such as C, N, Ni, Cu, Mn and the like are enriched. As a result, the temperature (the Ms point) at which the martensitic transformation of austenite portions starts and the temperature (the Mf point) at which the martensitic transformation is completed greatly decrease, so that some of the reverse transformed austenite particles remain in the form of relatively coarse particles when it is cooled down at room temperature.

In other words, the process in which coarse retained austenite particles are formed is characterized in that, when a steel is held for a time interval in a dual phase region (high temperature) in which atoms are active in diffusion, the content of an element diffused into the reverse transformed austenite increases, thereby causing both Ms and Mf points to be markedly decreased. As a result, the retained austenite particles formed in the steel become relatively coarse. Such coarse austenite particles may improve the toughness, but at the same time causes the mechanical strength to be decreased, thereby making it difficult to simultaneously obtain a high mechanical strength and a high toughness by applying the method for precipitating the retained austenite particles on the basis of the heating in a dual phase region.

In the following, it was examined whether or not the retained austenite can be precipitated in the form of a fine particle not by heating a 12% Cr-6.2% Ni-2.5% Mo-0.007% C steel similar to the above in a dual phase region, but by spontaneously cooling the steel. It was found that no retained austenite particles were precipitated, even if the cooling rate was varied, and that the toughness was relatively low, although a high mechanical strength was obtained.

However, in carrying out a similar experiment with the varied carbon content, it was found that a 11% Cr steel having a carbon content of greater than 0.01% provided a high mechanical strength and a high toughness, when it was heated in the austenite region at a temperature of $Ac_3$ point or more and then cooled relatively quickly at a high temperature range and cooled from the martensitic transformation point to room temperature without application of quenching.

FIG. 2 shows one of electron microscopic photographs of a metal structure which was obtained by the following procedures that a 11% Cr-0.5% Ni-0.25% Mo-0.03% C steel was first heated at a temperature of $Ac_3$ point or more, and cooled from 800° C. to 400° C. in an average cooling rate of 0.8° C./sec, and finally cooled from 400° C. to 150° C. at an average cooling rate of 0.13° C./sec.

In the metal structure shown in FIG. 2, very thin plate-like retained austenite particles can be found in lath interfaces of the martensite. It was found that the steel having such a structure provided a reduced mechanical strength but an excellent toughness. This results from the fine retained austenite particles. In other words, an increase in the number of the retained austenite particles provides a prominent effect in the improvement of the toughness. Nevertheless, a reduced absolute amount of the austenite particles provides only a small reduction in the mechanical strength.

Furthermore, the present inventors studied the process of retaining fine austenite particles in detail, and were able to understand the following facts [1] to [4]:

[1] When a material is cooled after heating at a temperature $Ac_3$ or more, the martensitic transformation starts at a temperature the Ms point or less, and in the temperature range from the Ms point to the Mf point the dual phase structure including the transformed martensite and the non-transformed austenite appears.

When the steel is not quenched, the C content gradually increases toward the austenite region, so that the Mf point lowers in the non-transformed austenite region. A further decrease in the temperature provides an enrichment of carbon in the austenite region in accordance with the process of martensitic transformation, and finally retains small austenite area having a lath interface at which the Mf point is lower than the room temperature. On the other hand, when the quenching is carried out at a temperature range of the Ms point or less, no enrichment in the austenite region occurs, so that no retained austenite appears.

[2] In the case of the above-mentioned heating in a dual phase region, when the steel is held at a high temperature, the reverse transformed austenite grows and the enrichment of C and N, together with alloy elements, such as Ni, Mn, Cu and the like, takes place in the austenite region. An increase in the alloy element content reduces the Ms point and the Mf point, and thereby most of the grown reverse transformed austenite areas remain as retained austenite. Accordingly, the retained austenite particles in the steel become coarse.

On the contrary, in the process in which the steel is heated at a temperature the $Ac_3$ point or more and then slowly cooled from a temperature in the vicinity of the Ms point, the enrichment of the alloy element content occur only at a lower temperature after the start of the martensitic transformation. Consequently, C and N are enriched in the austenite region, but Ni, Mn, Cu and the like are not enriched therein because they can hardly diffuse at a low temperature. A marked enrichment is restricted only to very small areas retained after the progress of the martensitic transformation. As a result, very fine retained austenite particles can be obtained.

[3] On the other hand, when the steel is slowly cooled at a temperature range of 800-400° C., carbides precipitate. As a result, no sufficient enrichment of carbon occurs even if a slow cooling is carried out in the low temperature range of 400-150° C., thereby causing no sufficient amount of retained austenite to be obtained. For this purpose, a certain degree of cooling rate is required so as to precipitate no carbide in a high temperature range before the start of the martensitic transformation.

[4] The retained austenite in the steel concentrates exclusively on the lath interfaces of the martensite and exhibits a plate-like structure having a thickness of not more than 100 nm. Moreover, the retained austenite appears as extremely thin layers, and therefore the quantitative X-ray analysis can hardly be applied, even if the normal measurement is carried out for X-ray integral intensities of 220γ, 200γ and 200α, and 211α. In view of these facts, using the strongest X-ray intensity 111γ, an index for the quantitative analysis $$111\gamma/(111\gamma+110\alpha)$$

can be introduced, where

111γ: X-ray integral intensity of austenite phase (111) plane and

110α: X-ray integral intensity of martensite phase (110) plane.

It is found that, when the following formula (a) is satisfied, $$0.005 \leqq 111\gamma/(111\gamma+110\alpha) \leqq 0.05 \quad \text{(a)}$$

a decrease in the mechanical strength may be suppressed and an excellent toughness may be obtained.

In the above description, the lath interface means an interface, which is newly formed by the martensitic transformation, and it includes an interface of packet and/or block, which is an interface between laths having different orientations.

BEST MODE FOR CARRYING OUT THE INVENTION

Figure 1:
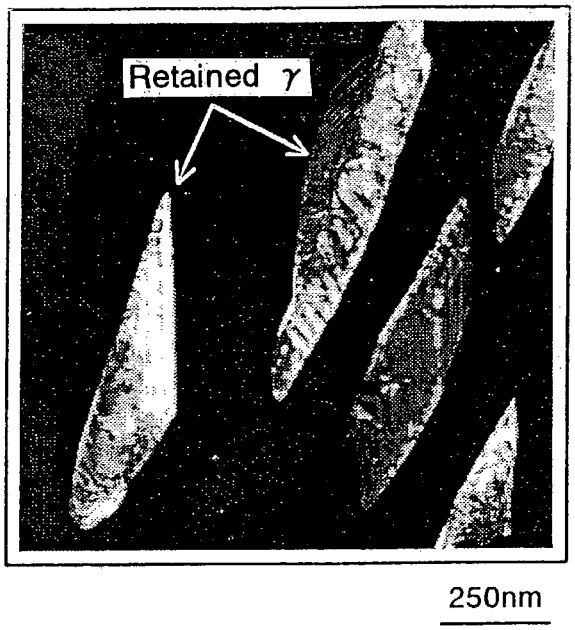
FIG. 1 is one of electron microscopic photographs of a metal structure obtained by heating a 12% Cr-6.2% Ni-2.5% Mo-0.007% C steel in a dual phase region (640° C. for 1 hr, natural cooling).
Figure 2:
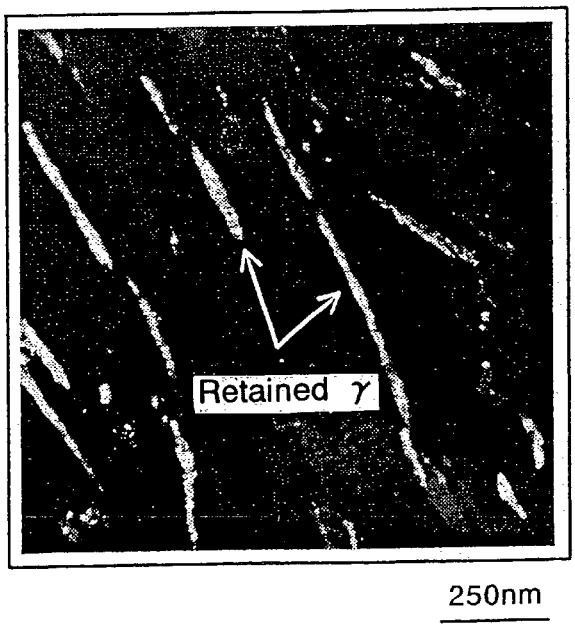
FIG. 2 is one of electron microscopic photographs of a metal structure obtained by slowly cooling from a temperature in the vicinity of the martensitic transformation temperature to room temperature a 11% Cr-0.5% Ni-2.5% Mo-0.03% C steel which is heated at a temperature of the $Ac_3$ point or more.

In the present invention, the chemical composition, the metal structure and the manufacturing method are specified as above. The reason for such specification will be described. Firstly, the chemical composition of the martensitic stainless steel according to the invention will be described. In the following description, the chemical composition is expressed by mass %.

1. Chemical Composition of Steel

C: 0.01-0.1%

Carbon is an element for forming austenite, and provides an effect that the austenite is enriched and stabilized in the course of cooling, thereby remaining non-transformed. In the steel according to the invention, carbon concentrates in the non-transformed austenite regions on the martensite lath interfaces, thereby causing the austenite to be stabilized. In order to obtain such an effect, a carbon content of not less than 0.01% is required.

However, a carbon content of more than 0.1% provides a prominent increase in the mechanical strength of the steel, but also provides a marked decrease in the toughness. Moreover, chromium carbide tends to precipitate in grain boundaries, thereby causing the corrosion resistance and the stress corrosion crack resistance in a corrosive environment containing $CO_2$, $H_2S$ or the like to be deteriorated. In view of these facts, a usable range of carbon content should be determined so as to be 0.01-0.1%. In this case, the C content should be preferably greater than 0.02%, more preferably 0.02-0.08%, and further more preferably 0.02-0.045%.

Cr: 9-15%

Chromium is an element indispensable for obtaining the corrosion resistance of a stainless steel. In particular, this element is important for obtaining both the corrosion resistance and the stress corrosion crack resistance in a corrosive environment. A chromium content of not less than 9% practically provides a available reduction in the corrosion rate under various conditions. However, a chromium content more than 15% tends to form δ ferrite in the metal structure, thereby causing the mechanical strength to be decreased and further the hot workability and the toughness to be deteriorated. Accordingly, a usable range of Cr content should be determined so as to be 9-15%. In this case, a preferable range should be less than 9-12%.

As described above, regarding the chemical composition of the martensitic stainless steel according to the invention, there is no special limitation, except for C and Cr. Hence, the steel according to the invention pertains to a conventional martensitic stainless steel. However, aside from C and Cr, the martensitic stainless steel according to the invention preferably includes Si, Mn, P, S, Ni, Al and N in the following ranges of content, the residual being Fe and impurities.

Si: 0.05-1%

Silicon is an element serving as a deoxidizer. However, a silicon content less than 0.05% provides an incomplete effect of deoxidization. On the other hand, a silicon content more than 1% reduces the toughness. Accordingly, the preferable Si content should range from 0.05% to 1%

Mn: 0.05%-1.5%

Manganese is an element effective for increasing the mechanical strength of the steel material, and for forming austenite to suppress the precipitation of δ ferrite in the treatment of quenching a steel material, thereby causing the metal structure in the steel material to be stabilized and martensite to be formed. However, a Mn content of less than 0.05% provides a reduced effect for forming the maretensite. On the other hand, a Mn content of more than 1.5% deteriorates both the toughness and the corrosion resistance. Accordingly, a preferable Mn content should range from 0.05% to 1.5%.

P: Not More than 0.03%

Phosphor is normally included as an impurity in steel and has an extremely harmful influence on the toughness of the steel, along with the deterioration of the corrosion resistance in a corrosive environment containing $CO_2$ and the like. As a result, it is preferable that the P content should be as small as possible. However, there is no problem so long as the content is retained within 0.03%. Hence, the upper limit of the P content should be determined so as to be 0.03%.

S: Not More than 0.01%

Sulfur is included as an impurity in steel, similarly to P, and has an extremely harmful influence on the hot workability of the steel. As a result, it is preferable that the S content should be as small as possible. However, there is no problem so long as the content is retained within 0.01%. Hence, the upper limit of the S content should be determined so as to be 0.01%.

Ni: 0.1-7%

Nickel is an element effective for forming austenite and suppresses the precipitation of δ ferrites in the treatment of quenching a steel material, thereby causing the metal structure in the steel material to be stabilized and martensite to be formed. For this purpose, it is necessary that Ni is included in a content not less than 0.1%. However, a Ni content of more than 7% provides an increase in the price of the steel material as well as in the amount of retained austenite, thereby making it impossible to obtain a desired mechanical strength. Accordingly, the Ni content should be set to be preferably 0.1-7%, more preferably 0.1-3.0%, and further more preferably 0.1-2.0%.

Al: Not More than 0.05%

Aluminum should not always be included in steel. However, Al is an element effective as a deoxidizer. When, therefore, Al is used as a deoxidizer, it may be included in a content of not less than 0.0005%. However, an Al content more than 0.05% deteriorates the toughness of the steel. As a result, the Al content should be set to be not more than 0.05%.

N: Not More than 0.1%

Nitrogen should not always be included in steel, since it deteriorates the toughness. However, N is an element suppressing the precipitation of δ ferrites in the treatment of quenching a steel material, thereby causing the metal structure in the steel material to be stabilized and martensite to be formed. Accordingly, it may be included at need. An N content more than 0.1% markedly deteriorates the toughness and is apt to generate welding cracks in the welding process of steel material. As a result, the N content should be set to be not more than 0.1%.

In the martensitic stainless steel according to the invention, one or more of elements in the following components or in the following groups can be included:

Cu: 0.05-4%

Copper should not always be included. However, Cu serves to enhance the corrosion resistance and stress corrosion cracking resistance in a corrosive environment containing $CO_2$, $Cl^-$, and $H_2S$. Such an effect can be obtained with a Cu content not less than 0.05%. However, a Cu content more than 4% provides saturation in the effect and further reduces the hot workability and the toughness. Accordingly, it is preferable that the Cu content should be set to be 0.05-4% in case of wishing to include.

Mo: 0.05-3%

Molybdenum should not always be included. However, Mo serves to enhance the corrosion resistance and stress corrosion cracking resistance in a corrosive environment containing $CO_2$, $Cl^-$, and $H_2S$. Such an effect can be obtained with a Mo content not less than 0.05%. However, a molybdenum content more than 3% saturates such effect and further reduces both the hot workability and the toughness. Accordingly, it is preferable that the Mo content should be 0.05-3%, if necessary.

Group A; Ti: 0.005-0.5%, V: 0.005-0.5% and Nb: 0.005-0.5%

Each of these elements should not always be included. However, each element enhances the stress corrosion cracking resistance in a corrosive environment of $H_2S$. This effect can be obtained by adding one or more of these elements to the steel. A content of not less than 0.005% provides a prominent effect as for any one of Titanium, Vanadium and Niobium. However, a content more than 0.5% deteriorates the toughness of the steel. Accordingly, the content should be set to be 0.005-0.5% for anyone of Titanium, Vanadium and Niobium, when wishing to add.

Group B; B: 0.0002-0.005%, Ca: 0.0003-0.005%, Mg: 0.0003-0.005% and rare earth elements: 0.0003-0.005%

Each of these elements enhances the hot workability of steel. Therefore, when wishing to improve, in particular, the hot workability, it is preferable that one or more of these elements are added. Such a prominent effect can be obtained either at a content not less than 0.0002% in the case of Boron, or at a content not less than 0.0003% in the case of Calcium, Magnesium or rare earth elements. However, a content more than 0.005% for all the elements reduces the toughness and also deteriorates the corrosion resistance in a corrosive environment containing $CO_2$ and the like. Accordingly, the content should be set to be 0.0002-0.005% for Boron and 0.0003-0.005% for Calcium, Magnecium or rare earth elements.

2. Metal Structure

In accordance with a specific feature of the present invention, the martensitic stainless steel according to the invention includes the following retained austenite in the parent phase of martensite structure:

First of all, it is necessary to reside residual fine austenite phases having a thickness of not less than 100 nm, since coarse retained austenite particles significantly reduce the mechanical strength. In the case of retained austenite existing in grain boundaries of the old austenite, the enrichment of alloy elements due to the grain boundary diffusion becomes particularly prominent, and therefore coarse austenite particles are formed therein, thereby causing the mechanical strength to be greatly decreased. Accordingly, the retained austenite form sites in the present invention-mainly attribute to the lath interfaces in the martensite.

In accordance with the present invention, the thickness of the retained austenite is specified as follows: Retained austenite in a thin film of a steel material was taken in a dark field image by an electron microscope and then the minor axis thereof was measured. In the quantitative determination, each retained austenite was regarded as an approximate ellipse and then the minor axis thereof was determined by the image analysis method. Ten fields having an area of 1,750 nm×2,250 nm were selected at random from each specimen, and the minor axis was measured for all of the retained austenite particles in each field. Thereafter, the thickness of the austenite was determined as an average value from the measured minor axes.

In the following, it is necessary that the X-ray integral intensities 111γ and 110α satisfy the following formula (a):

$$0.005 \leqq 111\gamma/(111\gamma+110\alpha) \leqq 0.05 \quad \text{(a)}$$

where

111γ: X-ray integral intensity of austenite phase (111) plane and,

110α: X-ray integral intensity of martensite phase (110) plane.

In formula (a), 111γ/(111γ+110α) is a quantity which is determined in proportion to the amount of the retained austenite. When this quantity is smaller than 0.005, the amount of the retained austenite is too small to improve the toughness. On the other hand, when this quantity is more than 0.05, the amount of the retained austenite is too large to attain a high mechanical strength.

In the present invention, the X-ray diffraction intensity was measured at a scan speed of 0.2 degrees/min for the surface of respective samples, after removing the work-damaged layer by the chemical etching method. The integral intensities of 111γ and 110α were determined, using JADE(4.0) for Microsoft® Windows® by Rigaku Corp., after the background treatment and peak dispersion treatment were carried out.

3. Manufacturing Method

In the present invention, in order to obtain the above-mentioned retained austenite in a steel material including the chemical compositions specified by the present invention, the following manufacturing method is employed:

A steel material is heated at a temperature of the $Ac_3$ point or more to form a thick steel plate, steel pipe or the like with a hot working. Thereafter, the good thus formed is cooled from 800° C. to 400° C. at a cooling rate of not less than 0.08° C./sec and then cooled down to 150° C. at a cooling rate of not more than 1° C./sec. In another embodiment, even after cooled at room temperature, the steel material is heated at a temperature of the $Ac_3$ point or more as a final heat treatment. Thereafter, the material is cooled from 800° C. to 400° C. at a cooling rate of not less than 0.08° C./sec and then cooled down to 150° C. at a cooling rate of not more than 1° C./sec. In this case, the temperature of the $Ac_3$ point in the present invention is different from chemical component to chemical component, but it is generally about 750-850° C.

The reason why the cooling rate of not less than 0.08° C./sec should be employed in the temperature range of 800° C.-400° C. is due to the fact that, although the steel material has a very good quenching property, the employment of a cooling rate of less than 0.08° C./sec results in the precipitation of coarse carbides and therefore no sufficient enrichment of carbon can be obtained, even if a slow cooling is applied in the temperature range from 400° C. to 150° C., so that no sufficient amount of retained austenite can be obtained, thereby causing the toughness to be reduced.

As described above, in the structure of the steel material, carbon is enriched in regions of non-transformed austenite between martensite laths below a temperature of the Ms point and the austenite remains in the lath interfaces by stabilizing the austenite. In this case, when a cooling rate of greater than 1° C./sec is employed in the cooling from 400° C. to 150° C., the martensitic transformation is completed before carbon is concentrated inside the austenite, so that no sufficient amount of retained austenite can be obtained, thereby causing the toughness to be deteriorated. As a result, it is necessary to employ a cooling rate of less than 1° C./sec in the cooling stage from 400° C. to 150° C.

From the above-mentioned description of the chemical composition, the metal structure and the manufacturing method according to the present invention, it is clear that both the martensitic stainless steel and the manufacturing method thereof intend not to obtain a desirable metal structure by specifying the chemical component of the steel, but to obtain an excellent property regarding the mechanical strength and the toughness from a favorable metal structure by utilizing a steel material having a specified chemical component as well as by employing a suitable manufacturing method.

In view of the above, although the present invention is applicable to a wide range of the component, a specific limitation is required for at least carbon and chromium contents in order to obtain the aimed martensitic stainless steel by providing the above-specified retained austenite. These facts will be elucidated in preferred embodiments.

EXAMPLES

Fifteen different kinds of steel were used, whose chemical composition is listed in Table 1. Steel having a weight of 75 kg was melted in a vacuum melting furnace and then cast to form a steel slab. Thereafter, a diffusive annealing treatment was applied to the steel slab thus formed at a temperature of 1250° C. for 2 hours to form a block having a 50 mm thickness and a 120 mm width by forging.

TABLE 1

| Type of steel | Chemical composition (mass %) Residual: Fe and impurities | | | | | | | | | | | | | | | | |
|---|---|---|---|---|---|---|---|---|---|---|---|---|---|---|---|---|---|
| | C | Si | Mn | P | S | Cr | Ni | Mo | Cu | N | Al | Nb | Ti | V | B | Ca | Others |
| A | 0.028 | 0.34 | 1.07 | 0.012 | 0.0011 | 11.24 | 0.50 | 0.25 | 0.55 | 0.038 | 0.012 | | | 0.05 | | 0.0013 | |
| B | 0.073 | 0.12 | 0.45 | 0.016 | 0.0017 | 12.18 | 1.32 | | | 0.028 | 0.024 | | | 0.04 | | 0.0008 | |
| C | 0.041 | 0.38 | 1.01 | 0.016 | 0.0009 | 10.09 | 0.90 | 0.36 | | 0.009 | | | | | | 0.0015 | |
| D | 0.035 | 0.38 | 0.89 | 0.011 | 0.0008 | 11.44 | 0.43 | | | 0.036 | 0.016 | | | 0.03 | | | |
| E | 0.014 | 0.31 | 0.60 | 0.015 | 0.0018 | 9.91 | 0.66 | | | 0.035 | 0.006 | | | | | 0.0028 | |
| F | 0.058 | 0.30 | 0.73 | 0.011 | 0.0018 | 11.79 | 1.20 | | 0.43 | 0.015 | 0.017 | | | 0.03 | | | Mg:0.0035 |
| G | 0.071 | 0.26 | 0.32 | 0.015 | 0.0010 | 10.11 | 5.34 | 0.23 | 0.37 | 0.018 | 0.015 | | | | 0.0021 | 0.0016 | |
| H | 0.040 | 0.23 | 0.33 | 0.016 | 0.0012 | 11.65 | 1.01 | 0.15 | 0.48 | 0.025 | | | 0.014 | 0.08 | | | La:0.0023 |
| I | 0.019 | 0.28 | 1.07 | 0.011 | 0.0012 | 10.48 | 0.57 | | | 0.049 | 0.007 | 0.025 | | 0.03 | | | Ce:0.0032 |
| J | 0.026 | 0.30 | 1.11 | 0.012 | 0.0014 | 13.92 | 1.26 | 0.12 | 0.76 | 0.034 | 0.033 | | | | | 0.0010 | |
| K | 0.068 | 0.25 | 0.97 | 0.010 | 0.0014 | 11.71 | 0.19 | 0.37 | 0.69 | 0.022 | 0.025 | | | 0.06 | | | |
| L | 0.020 | 0.25 | 0.36 | 0.015 | 0.0011 | 12.10 | 5.70 | 1.95 | 0.10 | 0.007 | 0.011 | | 0.110 | | | 0.0011 | |
| M | 0.052 | 0.27 | 1.08 | 0.009 | 0.0009 | 16.71* | 0.74 | | | 0.029 | 0.017 | | | 0.03 | | | |
| N | 0.003* | 0.14 | 0.36 | 0.010 | 0.0013 | 11.87 | 0.42 | 0.14 | | 0.021 | 0.019 | | | | | | |
| O | 0.125* | 0.30 | 0.91 | 0.014 | 0.0015 | 11.86 | 0.92 | | | 0.021 | 0.021 | | | 0.06 | | | |

Note:
The symbol*indicates the outside the range specified by the invention.

The block thus formed was heated up to 1200° C. and then hot rolled to form six kinds of steel plates having a thickness of 7 mm, 15 mm, 20 mm, 25 mm, 35 mm and 45 mm, respectively. Thereafter, these steel plates were cooled at various cooling rates both in a high temperature range from 800° C. to 400° C. and in a low temperature range from 400° C. to 150° C. As for part of these steels, the re-heating was further carried out after cooled down to room temperature, and then the steels were again cooled under the same cooling conditions as above. The cooling rates which were applied after the hot rolling and after the re-heating, were determined, employing cooling means, such as air cool, compulsive air cool, mist cool, water cool, oil cool, slow cooling with a shielding cover or furnace cool in an appropriate manner for both the high temperature range of 800° C.-400° C. and the low temperature range of 400° C.-150° C., and detailed investigations were made, varying these cooling conditions. The steels indicated by marks 12, 27 and 28 were further tempered. The rolling finish temperature, the conditions of re-heating, the cooling rates and the tempering conditions are listed in Table 2.

TABLE 2

| Classification | Mark | Type of steel | Plate thickness (mm) | Rolling finish temperature | Re-heating Condition | Cooling rate from 800° C. to 400° C. after rolling completion or re-heating (° C./sec) | Cooling rate from 400° C. to 150° C. after rolling completion or re-heating (° C./sec) | Tempering condition |
|---|---|---|---|---|---|---|---|---|
| Invention Example | 1 | A | 25 | 1,000 | — | 0.8 | 0.13 | — |
| | 2 | B | 7 | 930 | 900° C. × 10 min | 2.1 | 0.23 | — |
| | 3 | C | 20 | 975 | 900° C. × 15 min | 1 | 0.12 | — |
| | 4 | D | 35 | 1,020 | 900° C. × 10 min | 0.4 | 0.1 | — |
| | 5 | E | 15 | 965 | — | 24.5 | 0.18 | — |
| | 6 | F | 45 | 1,050 | 900° C. × 20 min | 0.2 | 0.1 | — |
| | 7 | G | 25 | 1,000 | 880° C. × 10 min | 22 | 0.12 | — |
| | 8 | H | 45 | 1,050 | — | 0.14 | 0.11 | — |
| | 9 | I | 35 | 1,020 | — | 3.2 | 0.72 | — |
| | 10 | J | 7 | 930 | — | 1.7 | 0.25 | — |
| | 11 | K | 15 | 965 | 1,000° C. × 5 min | 0.1 | 0.02 | — |
| | 12 | L | 15 | 965 | — | 24 | 13.3 | 620° C. × 10 sec |
| Comparative Example | 13 | M | 35 | 1,020 | — | 0.5 | 0.1 | — |
| | 14 | N | 15 | 965 | — | 1.3 | 0.3 | — |
| | 15 | O | 25 | 1,000 | — | 1.1 | 0.13 | — |
| | 16 | A | 25 | 1,000 | — | 20.2 | 7.5 | — |
| | 17 | B | 20 | 930 | 900° C. × 10 min | 0.05 | 0.12 | — |
| | 18 | C | 7 | 975 | 970° C. × 10 min | 41.2 | 8.6 | — |
| | 19 | D | 35 | 1,020 | 930° C. × | 17.5 | 6.3 | — |

TABLE 2-continued

| Classification | Mark | Type of steel | Plate thickness (mm) | Rolling finish temperature | Re-heating Condition | Cooling rate from 800° C. to 400° C. after rolling completion or re-heating (° C./sec) | Cooling rate from 400° C. to 150° C. after rolling completion or re-heating (° C./sec) | Tempering condition |
|---|---|---|---|---|---|---|---|---|
| | | | | | 10 min | | | |
| | 20 | E | 15 | 965 | — | 21.7 | 8.4 | — |
| | 21 | F | 25 | 1,050 | 900° C. × 10 min | 19.8 | 6.8 | — |
| | 22 | G | 45 | 1,000 | 900° C. × 10 min | 0.06 | 0.1 | — |
| | 23 | H | 45 | 1,050 | — | 15.7 | 5.9 | — |
| | 24 | I | 35 | 1,020 | — | 8.6 | 3.2 | — |
| | 25 | J | 7 | 930 | — | 35.2 | 15 | — |
| | 26 | K | 15 | 965 | 900° C. × 15 min | 23.1 | 9.9 | — |
| | 27 | A | 15 | 965 | — | 1.2 | 0.25 | 600° C. × 30 min |
| | 28 | L | 15 | 965 | — | 23.8 | 8.9 | 640° C. × 30 min |

The properties of the steel plates thus produced were investigated as for the tensile property (yield stress: YS(MPa)), the impact property (fracture appearance transition temperature: vTrs (° C.)) and the distribution of retained austenite particles. The tensile test was made for each rod having a diameter of 4 mm, which was machined from the corresponding steel plate after the heat treatment. The Charpy impact test was made as for a 5 mm×10 mm×55 mm subsized block which was machined similarly from the corresponding steel plate after the heat treatment, using a 2 mm V notch test piece.

The thickness of the retained austenite was determined from the minor axis of the approximate ellipse in a dark field image of a thin film prepared from the steel material, employing an electron microscope, as described above. In the quantitative analysis, the shape of retained austenite particles was approximated to an ellipse and the minor axis of the ellipse was determined by means of an image analysis method. In this case, 10 image fields having an area of 1,750 nm×2,250 nm were selected at random from each specimen. All of the retained austenite particles were observed in the respective image fields, and the thickness of the austenite was determined by the average value of the minor axes thus determined. The steel materials, in which the thickness of the retained austenite is not more than 100 nm, are indicated by a symbol ○.

The amount of the retained austenite particles was determined for the respective specimens, using the X-ray diffraction method. In the preparation of these specimens, each steel material was cut to form a block having a 2 mm thickness and a 20 mm width and a 20 mm length, and then the work-damaged layer was removed by using the chemical etching method. The integral intensities of 111γ and 110α were measured at a scanning speed of 0.2 degree/min after the background treatment and peak separation treatment, employing JADE (4.0) for Microsoft® Windows® by Rigaku Corp., the value of 111γ/(111γ+110α) was determined.

The measurement results for thicknes of the retained austenite, the amount of the retained austenite, the yield stress and the impact property are listed in Table 3.

TABLE 3

| Classification | Mark | Type of steel | Retained austenite Thickness | Retained austenite 111 γ / (111 γ + 110 α) | Yield stress (MPa) | Impact property VTrs(° C.) |
|---|---|---|---|---|---|---|
| Inventive Example | 1 | A | ○ | 0.012 | 846 | −54 |
| | 2 | B | ○ | 0.026 | 968 | −73 |
| | 3 | C | ○ | 0.009 | 877 | −56 |
| | 4 | D | ○ | 0.015 | 885 | −56 |
| | 5 | E | ○ | 0.007 | 859 | −51 |
| | 6 | F | ○ | 0.019 | 856 | −68 |
| | 7 | G | ○ | 0.024 | 949 | −80 |
| | 8 | H | ○ | 0.014 | 891 | −40 |
| | 9 | I | ○ | 0.011 | 862 | −49 |
| | 10 | J | ○ | 0.011 | 897 | −55 |
| | 11 | K | ○ | 0.022 | 927 | −59 |
| | 12 | L | ○ | 0.008 | 809 | −50 |
| Comparative Example | 13 | M | ○ | 0.019 | 716 | 26 |
| | 14 | N | — | 0 | 601 | 21 |
| | 15 | O | ○ | 0.042 | 1227 | 35 |
| | 16 | A | — | 0 | 863 | 2 |
| | 17 | B | ○ | 0.003 | 997 | 9 |
| | 18 | C | — | 0 | 892 | 15 |

TABLE 3-continued

| Classification | Mark | Type of steel | Retained austenite Thickness | Retained austenite 111 γ / (111 γ + 110 α) | Yield stress (MPa) | Impact property VTrs(° C.) |
|---|---|---|---|---|---|---|
| | 19 | D | — | 0 | 952 | 24 |
| | 20 | E | — | 0 | 830 | −7 |
| | 21 | F | — | 0 | 935 | 13 |
| | 22 | G | ○ | 0.002 | 936 | −4 |
| | 23 | H | — | 0 | 932 | 17 |
| | 24 | I | — | 0 | 872 | 3 |
| | 25 | J | — | 0 | 930 | 15 |
| | 26 | K | — | 0 | 962 | 24 |
| | 27 | A | — | 0 | 730 | 64 |
| | 28 | L | X | 0.067 | 643 | −97 |

Based on Tables 1 to 3, the results of the embodiments were reviewed, after they are classified into those in the inventive example and those in comparative example. The results in the comparative example will firstly be discussed and then the inventive example will be described.

1. Comparative Examples (Marks 13 to 28)

Mark 13 indicates a result for a steel material including Cr content greater than the upper limit. The morphology of the retained austenite (thickness and number thereof) satisfied the conditions specified by the invention, but a greater number of δ ferrites were precipitated so that a desired mechanical strength could not be obtained.

Marks 14 and 15 indicate the results for steel materials including carbon content outside the specified range. The steel material of mark 14 pertained to a steel including extremely low content of carbon. The steel material provided a low mechanical strength and includes retained austenite, even if it was slowly cooled in the temperature range from 400° C. to 150° C. As a result, high toughness could not be obtained. The steel material of mark 15 had a C content greater than the upper limit. The retained austenite particles having a desired shape were obtained and the mechanical strength was extremely enhanced. Nevertheless the toughness decreased.

Marks 16 to 26 indicate the results either for the steel materials that were prepared under the condition specified by the invention but did not provide retained austenite particles having a desired shape, or for the steel material that provided retained austenite particles having a desired shape but a very reduced number thereof.

The steel materials of marks 17 and 22 were slowly cooled in the high temperature range of 800-400° C., thereby causing the carbides to be precipitated. Accordingly, carbon could not be sufficiently enriched and therefore retained austenite particles could not be obtained, thereby causing the toughness to be deteriorated. The steel materials of marks 16, 18 to 21 and 23 to 26 were quenched in the high temperature range of 800-400° C. in the cooling stage after rolling finished or after the re-heating, so that no carbides were generated and solved carbon could be obtained. However, the enrichment of carbon was suppressed by the quenching in the low temperature range of 400-150° C., thereby making it difficult to generate the retained austenite. As a result, the toughness was deteriorated, although a high mechanical strength could be obtained.

In the steel material of mark 27, a slow cooling was made in the low temperature range of 400-150° C. after finished the rolling, and a metal structure including the retained austenite could be obtained. However, the post tempering process decreased the mechanical strength and further decomposed the retained austenite, thereby making it impossible to obtain an excellent toughness.

In the steel material of mark 28, the treatment of precipitating the retained austenite, the treatment being commonly employed in usual martensitic stainless steels, was applied, and further the tempering was made in the region of dual phase, i.e., ferrite/austenite phase. The precipitation of retained austenite greatly improved the toughness. The thickness of the retained austenite did not satisfy the range specified by the invention, thereby making it impossible to obtain a high mechanical strength.

2. Inventive Examples (Marks 1 to 12)

Marks 1 to 11 indicate embodiments, in which, using a steel material specified by the invention, in a cooling stage after the completion of rolling or after the re-heating followed by the cooling down to room temperature, the steel material was cooled from 800° C. to 400° C. at a cooling rate not less than 0.08° C./sec to suppress the precipitation of carbides, and further slowly or mildly cooled in the low temperature range of 400-150° C. to form fine retained austenite particles, so that the metal structure specified by the invention was obtained. It is found that all the steel materials in the inventive example provided a high mechanical strength and a remarkably improved toughness, compared with those in the comparative example.

In the martensitic stainless steel according to the invention, the metal structure is further specified. Accordingly, the desired or aimed properties or performance of the stainless steel can also be obtained, if such a metal structure is obtained by utilizing the manufacturing method other than that specified by the invention. For instance, in the steel material of mark 12, the quenching was made in the low temperature range of 400-150° C. and then the tempering was made for very short time using an induction furnace to form fine retained austenite particles. This procedure pertains to the category of the so-called tempering process in a dual phase region. In this case, a high mechanical strength and a high toughness could be obtained. Hence, it can be recognized that the control of morphology in the retained austenite phase as specified by the present invention provides a high mechanical strength as well as a high toughness.

INDUSTRIAL APPLICABILITY

The martensitic stainless steel according to the present invention includes C: 0.01-0.1% and Cr: 9-15%, and retained austenite phase in the steel having a thickness of not more than 100 nm so that the X-ray integral intensities of 111γ and 110α a satisfy the following formura:

$$0.005 \leqq 111\gamma/(111\gamma+110\alpha) \leqq 0.05 \quad (a)$$

The martensitic stainless steel having such a chemical composition and such a structure has a relatively high content of carbon, thereby enabling a higher mechanical strength and a greater toughness to be obtained, together with an excellent corrosion resistance. Therefore, it is particularly effective to use the martensitic stainless steel according to the invention as a material for constructing a deep oil well. Moreover, there is no need to reduce the carbon content, as done in the conventional improved 13% Cr steel. In conjunction this, a decrease in the content of expensive Ni makes it possible to reduce the manufacturing cost.

What is claimed is:

1. A martensitic stainless steel comprising C: 0.01-0.08%, Si: 0.05-1%, Mn: 0.05-1.5%, P: not more than 0.03%, S: not more than 0.01%, Cr: 9-15%, Ni: 0.1-0.9%, Al: not more than 0.05% and N: not more than 0.1% in mass %, the residual being Fe and impurities, wherein the thickness of the retained austenite phase in the steel is not more than 100 nm, and wherein the X-ray integral intensities 111γ and 110α satisfy the following formula (a);

$$0.005 \leqq 111\gamma/(111\gamma+110\alpha) \leqq 0.05 \quad (a)$$

where 111γ is the X-ray integral intensity of austenite phase (111) plane and 110α is the X-ray intensity of martensite phase (110) plane.

2. A martensitic stainless steel according to claim 1, further comprising one or more of the below-described Group B in mass %, Group B; B: 0.0002-0.005%, Ca: 0.0003-0.005%, Mg: 0.0003-0.005% and rare earth elements: 0.0003-0.005%.

3. An article adapted for use in a corrosive environment, the article made from the steel of claim 1.

4. The article of claim 3, wherein the article is a pipe.

5. A martensitic stainless steel comprising C: 0.01-0.08%, Si: 0.05-1%, Mn: 0.05-1.5%, P: not more than 0.03%, S: not more than 0.01%, Cr: 9-15%, Ni: 0.1-0.9%, Al: not more than 0.05% and N: not more than 0.1%, and further Cu: 0.05-4% in mass %, the residual being Fe and impurities, wherein the thickness of the retained austenite phase in the steel is not more than 100 nm, and wherein the X-ray integral intensities 111γ and 110α satisfy the following formula (a);

$$0.005 \leqq 111\gamma/(111\gamma+110\alpha) \leqq 0.05 \quad (a)$$

where 111γ is the X-ray integral intensity of austenite phase (111) plane and 110α is the X-ray intensity of martensite phase (110) plane.

6. A martensitic stainless steel according to claim 5, further comprising one or more of the below-described Group B in mass %, Group B; B: 0.0002-0.005%, Ca: 0.0003-0.005%, Mg: 0.0003-0.005% and rare earth elements: 0.0003-0.005%.

7. A martensitic stainless steel comprising C: 0.01-0.08%, Si: 0.05-1%, Mn: 0.05-1.5%, P: not more than 0.03%, S: not more than 0.01%, Cr: 9-15%, Ni: 0.1-0.9%, Al: not more than 0.05% and N: not more than 0.1%, and further Mo: 0.05-3% in mass %, the residual being Fe and impurities, wherein the thickness of the retained austenite phase in the steel is not more than 100 nm, and wherein the X-ray integral intensities 111γ and 110α satisfy the following formula (a);

$$0.005 \leqq 111\gamma/(111\gamma+110\alpha) \leqq 0.05 \quad (a)$$

where 111γ is the X-ray integral intensity of austenite phase (111) plane and 110α is the X-ray intensity of martensite phase (110) plane.

8. A martensitic stainless steel according to claim 7, further comprising one or more of the below-described Group B in mass %, Group B; B: 0.0002-0.005%, Ca: 0.0003-0.005%, Mg: 0.0003-0.005% and rare earth elements: 0.0003-0.005%.

9. A martensitic stainless steel comprising C: 0.01-0.08%, Si: 0.05-1%, Mn: 0.05-1.5%, P: not more than 0.03%, S: not more than 0.01%, Cr: 9-15%, Ni: 0.1-0.9%, Al: not more than 0.05% and N: not more than 0.1%, and further Cu: 0.04-4% and Mo: 0.05-3% in mass %, the residual being Fe and impurities, wherein the thickness of the retained austenite phase in the steel is not more than 100 nm, and wherein the X-ray integral intensities 111γ and 110α satisfy the following formula (a);

$$0.005 \leqq 111\gamma/(111\gamma+110\alpha) \leqq 0.05 \quad (a)$$

where 111γ is the X-ray integral intensity of austenite phase (111) plane and 110α is the X-ray intensity of martensite phase (110) plane.

10. A martensitic stainless steel according to claim 9, further comprising one or more of the below-described Group B in mass %, Group B; B: 0.0002-0.005%, Ca: 0.0003-0.005%, Mg: 0.0003-0.005% and rare earth elements: 0.0003-0.005%.

11. A martensitic stainless steel comprising C: 0.01-0.08%, 0.05-1%, Mn: 0.05-1.5%, P: not more than 0.03%, S: not more than 0.01%, Cr: 9-15%, Ni: 0.1-0.9%, Al: not more than 0.05% and N: not more than 0.1% and further one or more of the below-described Group A in mass %, the residual being Fe and impurities, Group A; Ti: 0.005-0.5%, V: 0.005-0.5% and Nb: 0.005-0.5%, wherein the thickness of the retained austenite phase in the steel is not more than 100 nm, and wherein the X-ray integral intensities 111γ and 110α satisfy the following formula (a);

$$0.005 \leqq 111\gamma/(111\gamma+110\alpha) \leqq 0.05 \quad (a)$$

where 111γ is the X-ray integral intensity of austenite phase (111) plane and 110α is the X-ray intensity of martensite phase (110) plane.

12. A martensitic stainless steel according to claim 11, further comprising one or more of the below-described Group B in mass %, Group B; B: 0.0002-0.005%, Ca: 0.0003-0.005%, Mg: 0.0003-0.005% and rare earth elements: 0.0003-0.005%.

13. A martensitic stainless steel comprising C: 0.01-0.08%, Si: 0.05-1%, Mn: 0.05-1.5%, P: not more than 0.03%, S: not more than 0.01%, Cr: 9-15%, Ni: 0.1-0.9%, Al: not more than 0.05% and N: not more than 0.1% and further Cu: 0.05-4% and one or more of the below-described Group A in mass %, the residual being Fe and impurities, Group A; Ti: 0.005-0.5%, V: 0.005-0.5% and Nb: 0.005-0.5%, wherein the thickness of the retained austenite phase in the steel is not more than 100 nm, and wherein the X-ray integral intensities 111γ and 110α satisfy the following formula (a);

$$0.005 \leqq 111\gamma/(111\gamma+110\alpha) \leqq 0.05 \quad (a)$$

where 111γ is the X-ray integral intensity of austenite phase (111) plane and 110α is the X-ray intensity of martensite phase (110) plane.

14. A martensitic stainless steel according to claim 13, further comprising one or more of the below-described Group B in mass %, Group B; B: 0.0002-0.005%, Ca: 0.0003-0.005%, Mg: 0.0003-0.005% and rare earth elements: 0.0003-0.005%.

15. A martensitic stainless steel comprising C: 0.01-0.08%, Si: 0.05-1%, Mn: 0.05-1.5%, P: not more than 0.03%, S: not more than 0.01%, Cr: 9-15%, Ni: 0.1-0.9%, Al: not more than 0.05% and N: not more than 0.1% and further Mo: 0.05-3% and one or more of the below-described Group A in mass %, the residual being Fe and impurities, Group A; Ti: 0.005-0.5%, V: 0.005-0.5% and Nb: 0.005-0.5%, wherein the thickness of the retained austenite phase in the steel is not more than 100 nm, and wherein the X-ray integral intensities 111γ and 110α satisfy the following formula (a);

$$0.005 \leqq 111\gamma/(111\gamma+110\alpha) \leqq 0.05 \quad (a)$$

where 111γ is the X-ray integral intensity of austenite phase (111) plane and 110α is the X-ray intensity of martensite phase (110) plane.

16. A martensitic stainless steel according to claim 15, further comprising one or more of the below-described Group B in mass %, Group B; B: 0.0002-0.005%, Ca: 0.0003-0.005%, Mg: 0.0003-0.005% and rare earth elements: 0.0003-0.005%.

17. A martensitic stainless steel comprising C: 0.01-0.08%, Si: 0.05-1%, Mn: 0.05-1.5%, P: not more than 0.03%, S: not more than 0.01%, Cr: 9-15%, Ni: 0.1-0.9%, Al: not more than 0.05% and N: not more than 0.1% and further Cu: 0.05-4%, Mo: 0.05-3% and one or more of the below-described Group A in mass %, the residual being Fe and impurities, Group A; Ti: 0.005-0.5%, V: 0.005-0.5% and Nb: 0.005-0.5%, wherein the thickness of the retained austenite phase in the steel is not more than 100 nm, and wherein the X-ray integral intensities 111γ and 110α satisfy the following formula (a);

$$0.005 \leqq 111\gamma/(111\gamma+110\alpha) \leqq 0.05 \quad (a)$$

where 111γ is the X-ray integral intensity of austenite phase (111) plane and 110α is the X-ray intensity of martensite phase (110) plane.

18. A martensitic stainless steel according to claim 17, further comprising one or more of the below-described Group B in mass %, Group B; B: 0.0002-0.005%, Ca: 0.0003-0.005%, Mg: 0.0003-0.005% and rare earth elements: 0.0003-0.005%.

* * * * *